US009410423B2

(12) United States Patent
Moon et al.

(10) Patent No.: US 9,410,423 B2
(45) Date of Patent: Aug. 9, 2016

(54) CORING TOOLS AND RELATED METHODS

(71) Applicant: Schlumberger Technology Corporation, Sugar Land, TX (US)

(72) Inventors: Barry Moon, Nisku (CA); Vincent Jeffrey Pisio, Edmonton (CA); Steven E. Buchanan, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 267 days.

(21) Appl. No.: 14/089,313

(22) Filed: Nov. 25, 2013

(65) Prior Publication Data

US 2014/0076634 A1 Mar. 20, 2014

Related U.S. Application Data

(62) Division of application No. 13/433,788, filed on Mar. 29, 2012, now Pat. No. 8,613,330.

(60) Provisional application No. 61/504,635, filed on Jul. 5, 2011.

(51) Int. Cl.

| | |
|---|---|
| ***E21B 49/00*** | (2006.01) |
| ***E21B 49/06*** | (2006.01) |
| ***E21B 49/02*** | (2006.01) |
| ***E21B 25/16*** | (2006.01) |
| ***E21B 25/00*** | (2006.01) |

(52) U.S. Cl.

CPC ..... *E21B 49/06* (2013.01); *E21B 25/00* (2013.01); *E21B 25/16* (2013.01); *E21B 49/00* (2013.01); *E21B 49/02* (2013.01)

(58) Field of Classification Search

CPC ..... E21B 49/00; E21B 49/06; E21B 49/02; E21B 25/00; E21B 25/16; E21B 47/024

See application file for complete search history.

(56) References Cited

U.S. PATENT DOCUMENTS

| | | | |
|---|---|---|---|
| 366,913 | A | 7/1887 | Ball |
| 1,830,681 | A | 11/1931 | Scott |
| 1,932,612 | A | 10/1933 | Williston |
| 2,044,057 | A | 6/1936 | Burt |
| 2,181,980 | A | 12/1939 | Seale |
| 2,230,568 | A | 2/1941 | Howard et al. |
| 2,252,620 | A | 8/1941 | Long |
| 2,306,369 | A | 12/1942 | Anderson |
| 2,343,793 | A | 3/1944 | Paget |
| 2,490,512 | A | 12/1949 | Deely |
| 2,558,227 | A | 6/1951 | Yancey et al. |
| 2,738,167 | A | 3/1956 | Williams, Jr. |
| 2,852,230 | A | 9/1958 | Garrison |
| 3,092,192 | A | 6/1963 | Deely |

(Continued)

FOREIGN PATENT DOCUMENTS

| | | | |
|---|---|---|---|
| GB | 2236780 | A | 4/1991 |
| GB | 2417045 | A | 2/2006 |

(Continued)

*Primary Examiner* — Yong-Suk (Philip) Ro

(74) *Attorney, Agent, or Firm* — Trevor G. Grove

(57) ABSTRACT

Disposing a coring tool in a borehole adjacent a subterranean formation to be sampled. Determining a property of the formation and selecting a coring tool operational mode based on the property of the formation. Obtaining a sample from the formation using the coring tool operational mode. A type of coring shaft also may be selected based on the property of the formation.

20 Claims, 9 Drawing Sheets

(56) References Cited

U.S. PATENT DOCUMENTS 3,428,138 A 2/1969 Casper et al.
3,537,743 A 11/1970 Martinsen
3,598,191 A 8/1971 Bullard
3,964,555 A 6/1976 Franklin
4,002,213 A 1/1977 Sweeney
4,258,803 A 3/1981 Thompson et al.
4,354,558 A * 10/1982 Jageler ..... E21B 4/02 173/36
4,424,183 A 1/1984 Nelson
4,518,051 A 5/1985 Sollie et al.
4,607,710 A 8/1986 Radford
4,609,056 A 9/1986 Colle et al.
4,629,011 A 12/1986 Reinhardt
4,667,753 A 5/1987 Jageler
4,669,082 A 5/1987 Tilghman et al.
4,702,168 A 10/1987 Colle et al.
4,714,119 A 12/1987 Hebert et al.
4,790,396 A 12/1988 Fuller
4,818,050 A 4/1989 Duthie
4,839,516 A 6/1989 Freeman et al.
4,864,846 A 9/1989 Jones
4,911,002 A 3/1990 Enderlin et al.
4,950,844 A 8/1990 Hallmark et al.
4,969,528 A 11/1990 Jurgens
4,979,576 A 12/1990 Barker et al.
4,981,183 A 1/1991 Tibbitts
4,996,489 A 2/1991 Sinclair
4,996,872 A 3/1991 Mueller et al.
5,025,872 A 6/1991 Behre et al.
5,029,653 A 7/1991 Jurgens et al.
5,031,536 A 7/1991 Barker et al.
5,052,502 A 10/1991 Jurgens et al.
5,105,894 A 4/1992 Enderlin
5,146,999 A 9/1992 Wiser et al.
5,163,522 A 11/1992 Eaton et al.
5,230,390 A 7/1993 Zastresek et al.
5,253,719 A 10/1993 Blauch et al.
5,277,062 A 1/1994 Blauch et al.
5,310,013 A 5/1994 Kishino et al.
5,325,723 A 7/1994 Meadows et al.
5,351,765 A * 10/1994 Ormsby ..... E21B 25/02 175/246
5,360,074 A 11/1994 Collee et al.
5,411,106 A * 5/1995 Maissa ..... E21B 49/06 175/250
5,439,065 A 8/1995 Georgi
5,482,123 A 1/1996 Collee
5,487,433 A * 1/1996 Mackay ..... E21B 49/06 175/250
5,546,798 A 8/1996 Collee et al.
5,554,302 A 9/1996 Carabine
5,560,438 A 10/1996 Collee et al.
5,568,838 A 10/1996 Struthers et al.
5,617,927 A 4/1997 Maissa
5,667,025 A * 9/1997 Haessly ..... E21B 49/06 175/249
5,741,707 A 4/1998 Herron et al.
5,868,030 A 2/1999 Brumley et al.
5,881,825 A 3/1999 Collee et al.
5,957,221 A 9/1999 Hay et al.
6,006,844 A 12/1999 Van Puymbroeck et al.
6,047,239 A 4/2000 Berger et al.
6,283,228 B2 9/2001 Collee et al.
6,341,656 B1 1/2002 Fanuel et al.
6,371,221 B1 4/2002 Harrigan et al.
6,394,196 B1 5/2002 Fanuel et al.
6,401,840 B1 6/2002 Hay et al.
6,412,575 B1 7/2002 Harrigan et al.
7,431,107 B2 * 10/2008 Hill ..... E21B 49/06 175/246
2002/0148643 A1 * 10/2002 Contreras ..... E21B 49/06 175/20
2003/0173116 A1 9/2003 Wells et al.
2009/0114447 A1 5/2009 Reid, Jr. et al.
2010/0000792 A1 * 1/2010 Alberty ..... E21B 47/026 175/50
2010/0084193 A1 4/2010 Livingstone
2010/0282516 A1 * 11/2010 Buchanan ..... E21B 49/06 175/58
2011/0094801 A1 * 4/2011 Buchanan ..... E21B 49/06 175/249

FOREIGN PATENT DOCUMENTS

JP 1161129 C 6/1989
JP 11236709 A 8/1999
SU 1157220 A1 5/1985

* cited by examiner

CORING TOOLS AND RELATED METHODS

RELATED APPLICATION

This application is a divisional of and claims priority to U.S. patent application Ser. No. 13/433,788, entitled "CORING TOOLS AND RELATED METHODS," now U.S. Pat. No. 8,613,330, which claims the benefit of the filing date of U.S. Provisional Application No. 61/504,635, filed on Jul. 5, 2011, the entire disclosures of which are incorporated herein by reference in their entirety.

BACKGROUND OF THE DISCLOSURE

Wellbores or boreholes may be drilled to, for example, locate and produce hydrocarbons. During a well development operation, it may be desirable to evaluate and/or measure properties of encountered formations, formation fluids and/or formation gasses. Some formation evaluations may include extracting a core sample (e.g., a rock sample) from sidewall of a wellbore. Core samples may be extracted using a coring tool coupled to a downhole tool that is lowered into the wellbore and positioned adjacent a formation. A hollow coring shaft or bit of the coring tool may be extended from the downhole tool and urged against the formation to penetrate the formation. A formation or core sample fills the hollow portion or cavity of the coring shaft and the coring shaft is removed from the formation retaining the sample within the cavity. The formation or core sample may then be removed from the coring shaft for further evaluation at, for example, a laboratory.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figures 1A, 1B:
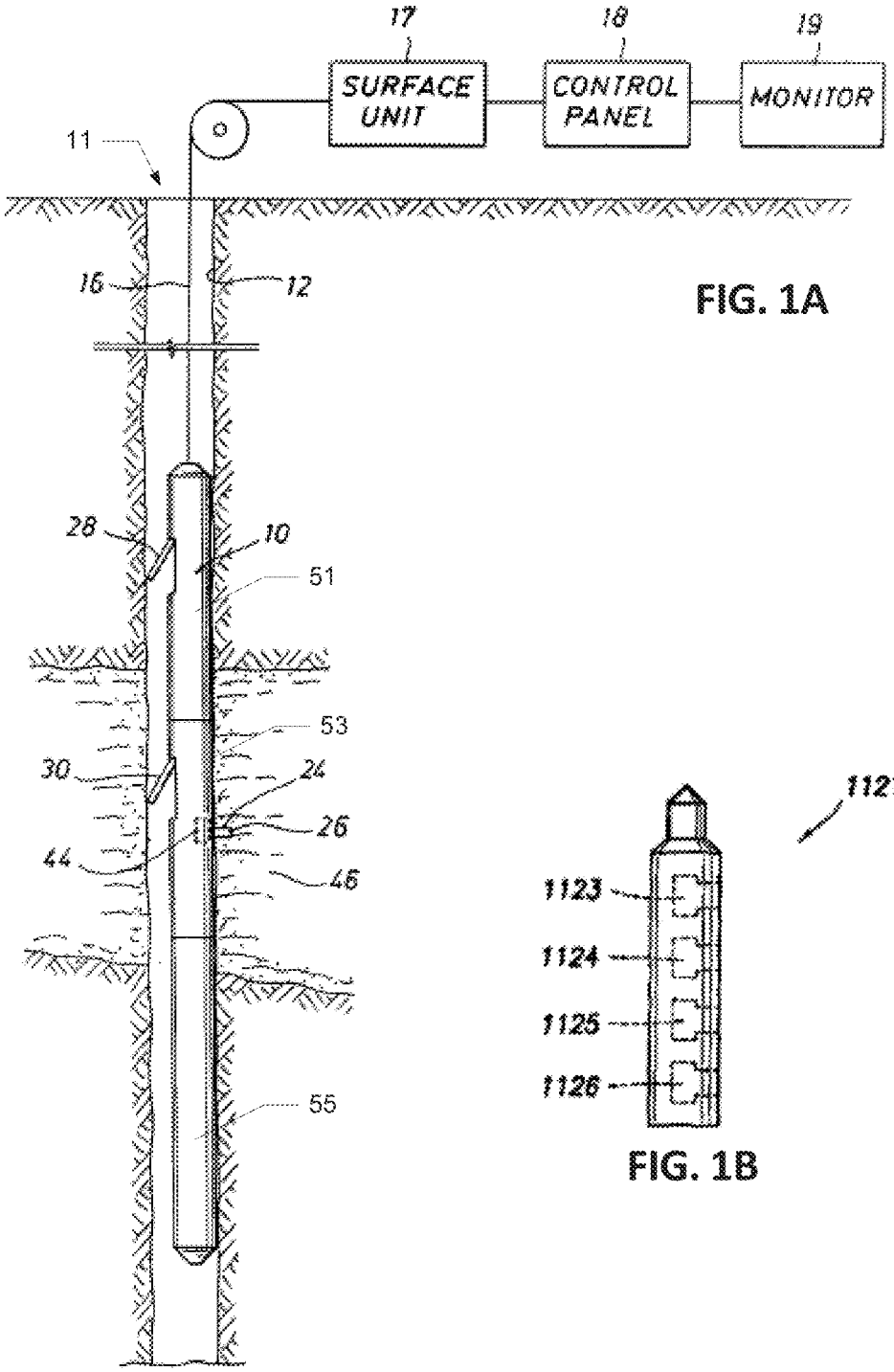
FIG. 1A is a schematic view of coring apparatus according to one or more aspects of the present disclosure.
FIG. 1B is a schematic view of another coring apparatus according to one or more aspects of the present disclosure.

It is to be understood that the following disclosure provides many different embodiments or examples for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact. Embodiments in which additional features may be formed interposing the first and second features such that the first and second features may not be in direct contact may also be included.

The example apparatus and methods described herein relate to coring tools and coring bits or shafts that may be used to collect samples (e.g., rock samples, tar sand samples, etc.) from subterranean formations adjacent a borehole or a wellbore. The example coring shafts described herein may be used in conjunction with sidewall coring apparatus and methods. The example coring shafts generally include a cylindrical body having a leading edge to contact and penetrate a subterranean formation to be sampled. The cylindrical body has a cavity defined at least in part by an inner surface of the cylindrical body. Additionally, the inner surface of the cylindrical body may include a plurality of raised features to engage and retain a sample from the formation. The raised features may be shaped so that the raised features deform and/or an exterior surface of the sample in the cavity deforms, thereby increasing an amount of force required to remove the sample from the cavity. In this manner, the raised features of the inner surface of the example coring shafts may become at least partially embedded in a sample captured within the cavity. As a result, the example coring shafts or bits described herein may provide a substantially greater amount of sample retention force compared to many known coring bits or shafts.

The example coring shafts described herein may use one or more types of raised features and/or surface treatments. For example, knurls or a knurled surface, a helical ridge, a spiraled ridge, threads, serrations and/or axial ridges may be used. Such raised features are shaped to provide portions or areas of relatively greater stress or force concentration against a formation or core sample and, thus, may be capable of causing the above-mentioned deformation(s). Additionally, different leading edge configurations may be used to implement the example coring shafts including, for example, bevels, lips, wedges and/or a diamond cutter to suit a particular application or applications.

In another aspect, the example coring shafts described herein may employ a circumferential groove or grooves on an exterior surface of the cylindrical body of the coring shaft to provide a relatively weakened portion or area on the coring shaft. In particular, the groove or grooves may result in at least a portion of a wall of the coring shaft having a reduced thickness sufficient to cause the cylindrical body to fracture and shear off in response to a predetermined load, torque, or force, thereby facilitating withdrawal of a coring tool from a sidewall of a borehole despite the coring shaft becoming stuck in the sidewall.

The example methods described herein may involve selecting a coring shaft type for use in sampling a formation based on a property of the formation. For example, in the case where the formation property relates to formation strength or formation lithology (e.g., tar sand), such a property or properties may be used to select a coring shaft having a relatively larger diameter or a relatively smaller diameter. The property of the formation may also result in selection of a coring shaft having a particular leading edge configuration such as, for example, a wedge or a diamond cutter configuration. The example methods may be employed with the example coring shaft or bits described herein or any other coring shafts or bits.

In another aspect, the example methods described herein may involve selecting an operational mode(s) for a coring tool based on a property or properties of a formation to be sampled. More specifically, the lithology of a formation may be used to select a punching or drilling operational mode for the coring tool and/or selecting whether each coring shaft of the coring tool is to collect one or multiple formation samples. Thus, the example methods noted above and described in more detail below can be used to enhance or optimize a coring operation through the selection of a particular coring shaft or bit configuration and/or a manner in which the coring tool is to be operated for use with a formation having particular properties.

FIG. 1A depicts a coring tool 10 with which the example methods and coring shaft or bit apparatus described herein can be used. As shown, the coring tool 10 may be used in a drilled well to obtain core samples from a downhole or subterranean geologic formation. In operation, the coring tool 10 is lowered into a borehole 11 defined by a bore wall 12, commonly referred to as the sidewall. The coring tool 10 is connected by one or more electrically conducting cables 16 to a surface unit 17 that includes a control panel 18 and a monitor 19. The surface unit 17 is designed to provide electrical power to the coring tool 10, to monitor the status of downhole coring and activities of other downhole equipment, and to control the activities of the coring tool 10 and other downhole equipment.

The coring tool 10 is generally contained within an elongate housing suitable for being lowered into and retrieved from the borehole 12. The coring tool 10 may include an electronic sonde 51, a mechanical sonde 53, and a core magazine 55. The mechanical sonde 53 contains a coring assembly including at least one motor 44 powered through the cables 16, a coring bit or shaft 24 having a distal, open end 26 for cutting and receiving a core sample from a formation 46, and a mechanical linkage (not shown) for deploying and retracting the coring shaft 24 relative to the coring tool 10 and for rotating the coring shaft 24 against the sidewall 12.

FIG. 1A shows the coring tool 10 in an active, cutting configuration. The coring tool 10 is positioned adjacent the formation 46 and urged firmly against the sidewall 12 by anchoring shoes 28 and 30, which are extended from a side of the coring tool 10 opposing the coring shaft 24. The distal, open end 26 of the coring shaft 24 may be rotated via the motor 44 against the formation 46 to cut a core sample from the formation 46.

FIG. 1B shows the general features of another type of coring tool 1121 with which the example methods and apparatus described herein can be used. This coring tool 1121 includes a plurality of coring shafts 1123, 1124, 1125, 1126, each of which may be used to collect and store a single formation sample.

While FIGS. 1A and 1B show coring tools deployed at the end of a wireline cable, a coring tool may be deployed in a well using any known or future-developed conveyance means, including drill pipe, coiled tubing, etc.

Figure 2:
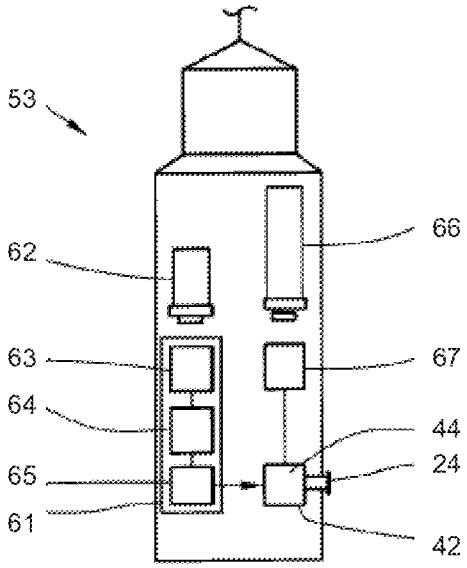
FIG. 2 is a schematic view of a coring apparatus according to one or more aspects of the present disclosure.

FIG. 2 is a schematic view of an example mechanical sonde, such as the mechanical sonde 53 of FIG. 1A. As shown in FIG. 2, the mechanical sonde 53 includes a coring assembly having the coring bit or shaft 24 and a housing 42. To cut a core sample from the formation 46 with the coring shaft 24, the mechanical sonde 53 uses a thrusting actuator to urge (e.g., punch, press, drive, etc.) the coring shaft 24 into the formation 46 and applies a weight-on-bit (WOB), which is a force that urges the coring shaft 24 into the formation 46. The mechanical sonde 53 may include a rotating actuator to apply a torque to rotate the coring shaft 24, thereby drilling the coring shaft 24 into the formation 46.

For example, the WOB provided by the mechanical sonde 53 and applied to the coring shaft 24 may generated by an electric motor 62 and a control assembly 61 that includes a hydraulic pump 63, a feedback flow control ("FFC") valve 64, and a kinematics piston 65. The electric motor 62 supplies power to the hydraulic pump 63. The flow of hydraulic fluid from the hydraulic pump 63 is regulated by the FFC valve 64, and the pressure of hydraulic fluid drives the kinematics piston 65 to apply a WOB to the coring shaft 24. The FFC valve 64 may regulate the flow of hydraulic fluid to the kinematics piston 65 based on the hydraulic pressure applied to a hydraulic coring motor 44. Also, for example, to rotate the coring shaft 24, torque may be provided by an electric motor 66 and a gear pump 67. The electric motor 66 drives the gear pump 67, which supplies flow of hydraulic fluid to the hydraulic coring motor 44. The hydraulic coring motor 44, in turn, imparts a torque to the coring shaft 24 that causes the coring shaft 24 to rotate.

Figure 3:
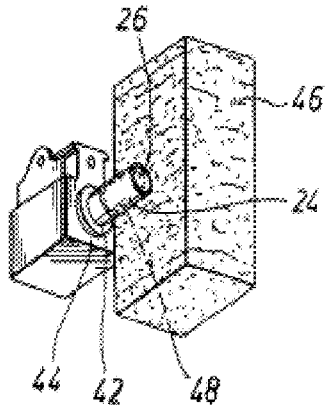
FIG. 3 is a perspective view of a coring apparatus according to one or more aspects of the present disclosure.

FIG. 3 shows a perspective view of an example coring apparatus, such as the apparatus including the coring shaft 24, the housing 42 and the hydraulic motor 44 of FIGS. 1A and 2, when the coring apparatus is cutting or has cut into the formation 46. A core sample 48 may be received into a hollow interior or cavity of the coring shaft 24 as cutting progresses.

Figure 4A:
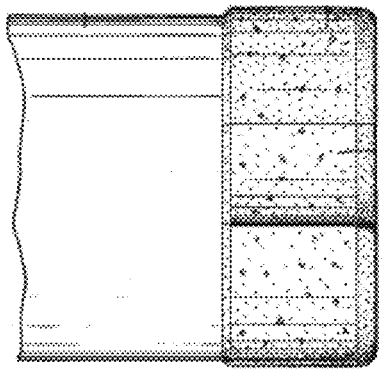
FIG. 4A (prior art)
FIGS. 4A and 4B depict a known coring shaft or bit.
Figure 4B:
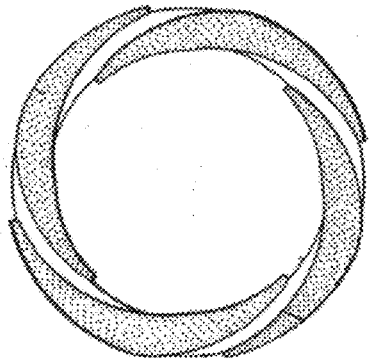
FIG. 4B (prior art)

FIGS. 4A and 4B depict a partial side view and an end view of a known coring shaft or bit. More specifically, the coring bit of FIGS. 4A and 4B is a surface set diamond bit. A more detailed description of such a coring bit can be found in U.S. Pat. No. 4,189,015, the disclosure of which is hereby incorporated by reference herein in its entirety. The known coring shaft or bit shown in FIGS. 4A and 4B typically provides an internal cavity diameter of between about 1 and 1.5 inches, which may be substantially smaller than the examples described below in connection with FIGS. 5-7.

Figure 5A:
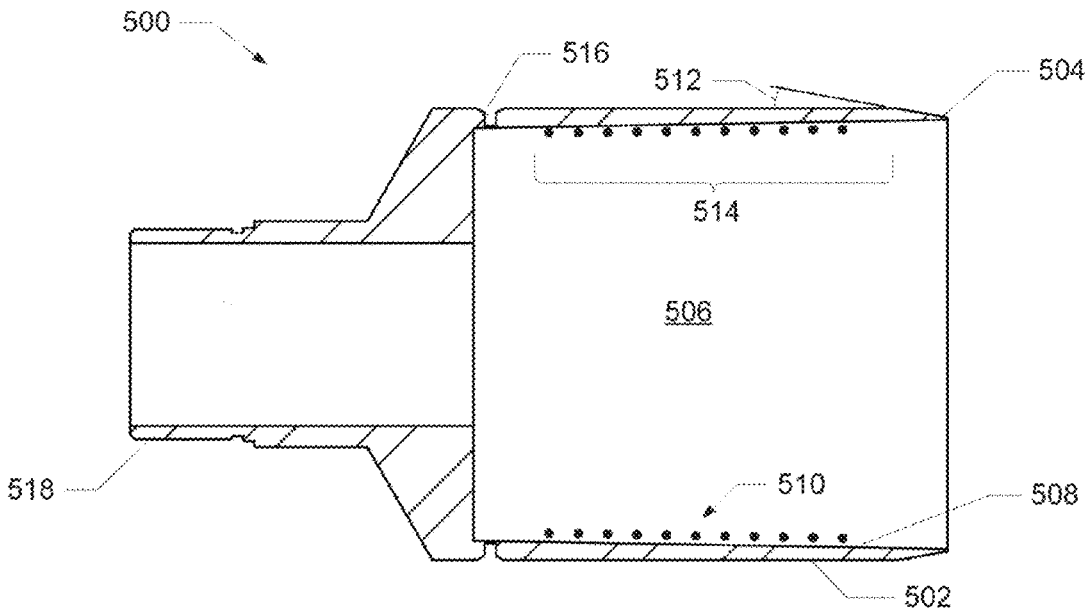
FIG. 5A is a sectional view of a coring shaft according to one or more aspects of the present disclosure.
Figure 5B:
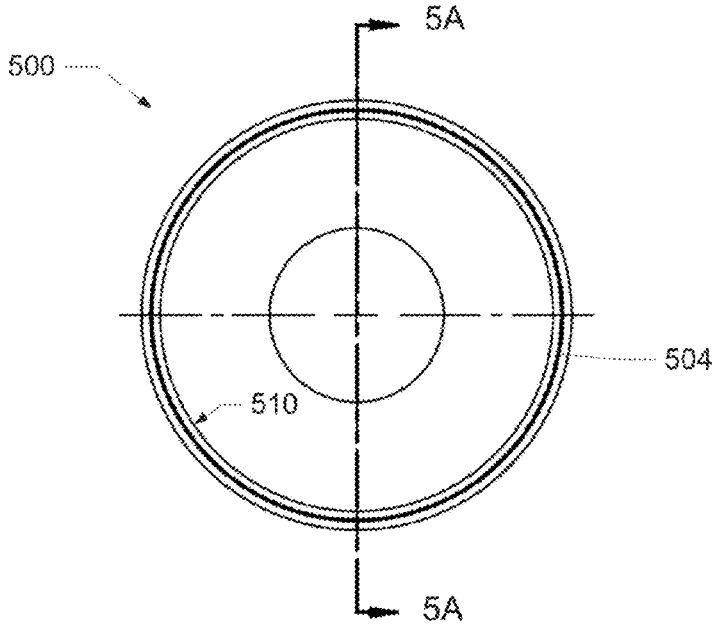
FIG. 5B is an end view of the coring shaft of FIG. 5A.

FIGS. 5A and 5B show a sectional view and an end view of an example coring bit or shaft 500 according to aspects of this disclosure. The example coring shaft 500 has a generally cylindrical body 502 having a leading edge 504 to contact and penetrate a formation (e.g., the formation 46). The cylindrical body 502 includes a cavity 506 that is defined at least partially by an inner surface 508 of the cylindrical body 502. The inner surface 508 is to engage and facilitate the retention of a core sample cut from a formation. For example, a substantial portion of the inner surface 508 may have a surface treatment such as a plurality of raised features 510.

Figure 8A:
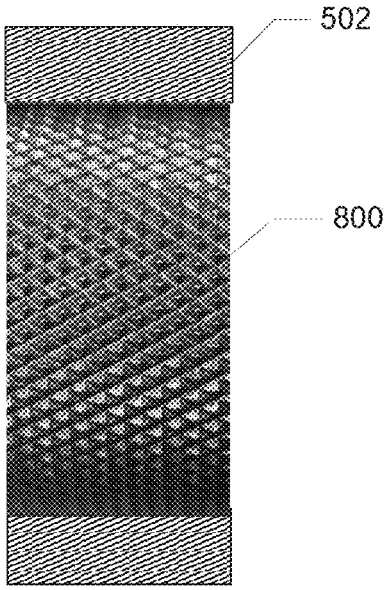
FIGS. 8A-8C depict inner surfaces for coring shafts according to one or more aspects of the present disclosure.
Figure 8B:
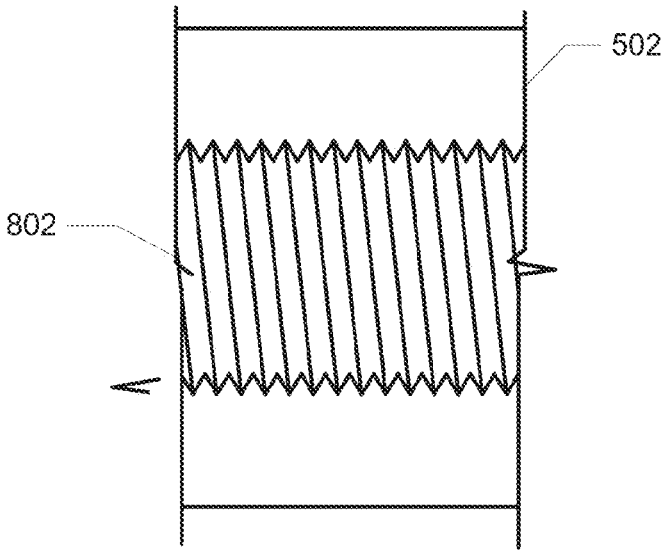
Figure 8C:
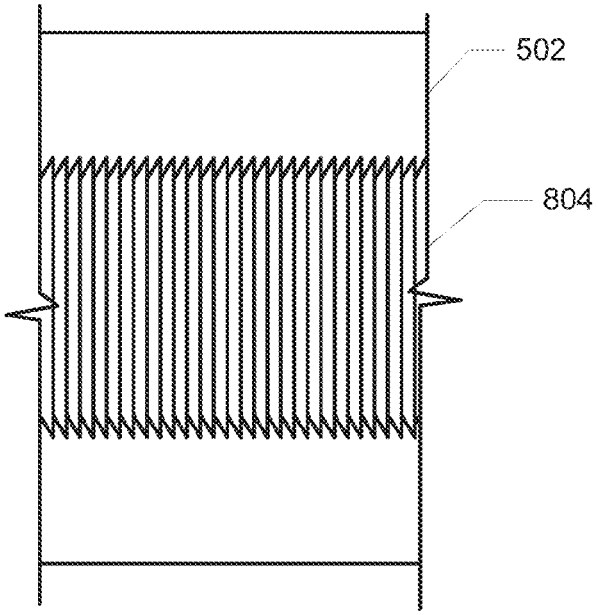

Turning briefly to FIGS. 8A, 8B and 8C, various types of surface treatments or example implementations of the raised features 510 are shown. FIG. 8A depicts a knurled surface or knurls 800, FIG. 8B depicts a spiraled ridge, a helical ridge or threads 802, and FIG. 8C depicts axial ridges or serrations 804. The axial ridges or serrations of FIG. 8C may have an asymmetrical profile. In the case of the example of FIG. 8B, the threads may have a pitch of twelve threads per inch and have a v-groove profile about 0.1 inch deep. The threads may span about 1.4 inches and may be left or right-handed. However, other pitches, dimensions and spans may be used without departing from the scope of the present disclosure.

Returning to FIG. 5A, the raised features 510 are shaped to increase a stress concentration or force at the points of contact between the raised features 510 and a sample within the cavity 506. Such increased stress and/or force may deform an exterior surface of the sample and/or may deform the raised features, depending on the relative hardness of the sample and the material from which the raised features 510 are formed. In any event, such deformation may result in the raised features becoming at least partially embedded within the sample or at least creating a increased amount of mechanical interference contact between the sample and the inner surface 508, thereby substantially increasing the force applied to remove the sample from the cavity 506.

The leading edge 504 of the coring shaft 500 may be urged into a formation via a thrusting, punching or pressing operation using, for example, WOB provided by the electric motor 62, the control assembly 61, the hydraulic pump 63, the FFC valve 64, and the kinematics piston 65 as discussed above in connection with FIG. 2. In that case, the leading edge 504 may include a bevel, a lip or a wedge-shaped profile. In the example of FIG. 5A, the leading edge has a taper angle 512, which may, for example, be about ten degrees. However, the taper angle 512 may be selected to suit a particular application. The leading edge 504 may also be rotated or drilled into a formation. For example, the leading edge 504 may include a diamond cutter bit similar to that shown in FIGS. 4A and 4B.

The inner surface 508, including the innermost surfaces or edges of any surface treatment thereon, may be tapered over at least a portion 514. This taper may be about two degrees or any other taper angle to enable removal of the sample from the cavity 506.

In contrast to many known coring shafts, the example coring shaft 500 may provide a relatively large formation sample. For example, the cavity 506 may have a diameter of approximately two inches and a length of approximately two inches. However, other diameters and lengths can be used without departing from the scope of this disclosure.

The cylindrical body 502 has a wall having reduced thickness portion 516 to cause the cylindrical body 502 to fracture or shear (at the portion 516) in response to a predetermined load (e.g., torque, force, etc.). The portion 516 may be formed as a continuous circumferential groove as depicted in FIG. 5A or may be an interrupted (i.e., discontinuous) groove, a plurality of holes or thinned sections, or any other configuration that serves to provide a relatively weaker portion of the cylindrical body 502. In this manner, in the event that the cylindrical body 502 of the coring shaft 500 becomes stuck in a sidewall, the coring tool carrying the coring shaft 500 (e.g., the coring tool 10 of FIG. 1A) can impart a sufficient load to shear off the cylindrical body 502 at the reduced thickness portion 516, thereby enabling removal of the coring tool.

The example coring shaft 500 also includes an end 518 that enables the coring shaft 500 to be removably coupled to a thrusting actuator (see one example in FIG. 2) and optionally a rotating actuator (see one example in FIG. 2).

Figure 6:
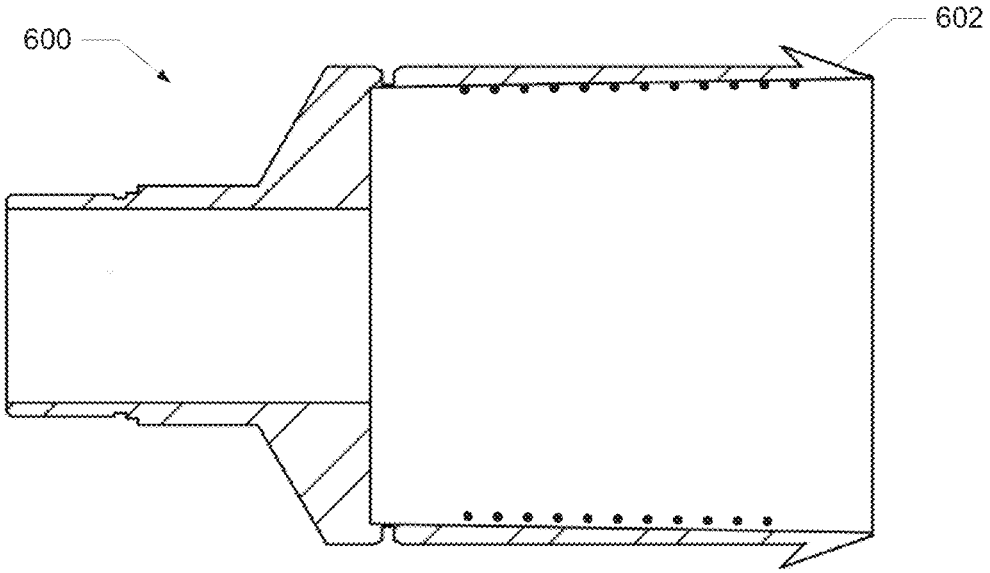
FIG. 6 is a sectional view of another coring shaft according to one or more aspects of the present disclosure.
Figure 7:
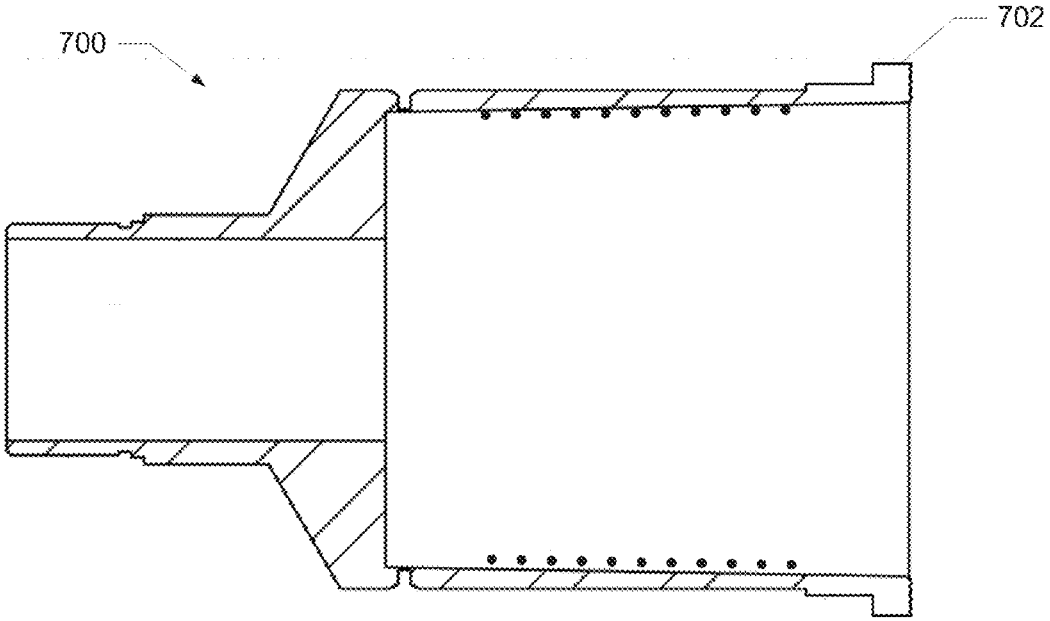
FIG. 7 is a sectional view of another coring shaft according to one or more aspects of the present disclosure.

FIGS. 6 and 7 are sectional views of alternative example coring shafts 600 and 700 that may be used with a coring tool such as the coring tool 10 of FIG. 1A. The example coring shaft 600 of FIG. 6 has a leading edge configuration having a lip 602 and the example coring shaft 700 of FIG. 7 has a catcher ring type leading edge 702. The lip 602 and the leading edge 702 shown in FIGS. 6 and 7, respectively, may be used to provide a space or gap between an outer surface of a drill shaft and the inner surface of a wellbore. Such a gap or space may be used to enable a drill motor to rotate about an axis perpendicular to the longitudinal axis of the wellbore (e.g., cock) at its end of travel to snap off the core.

Figure 9:
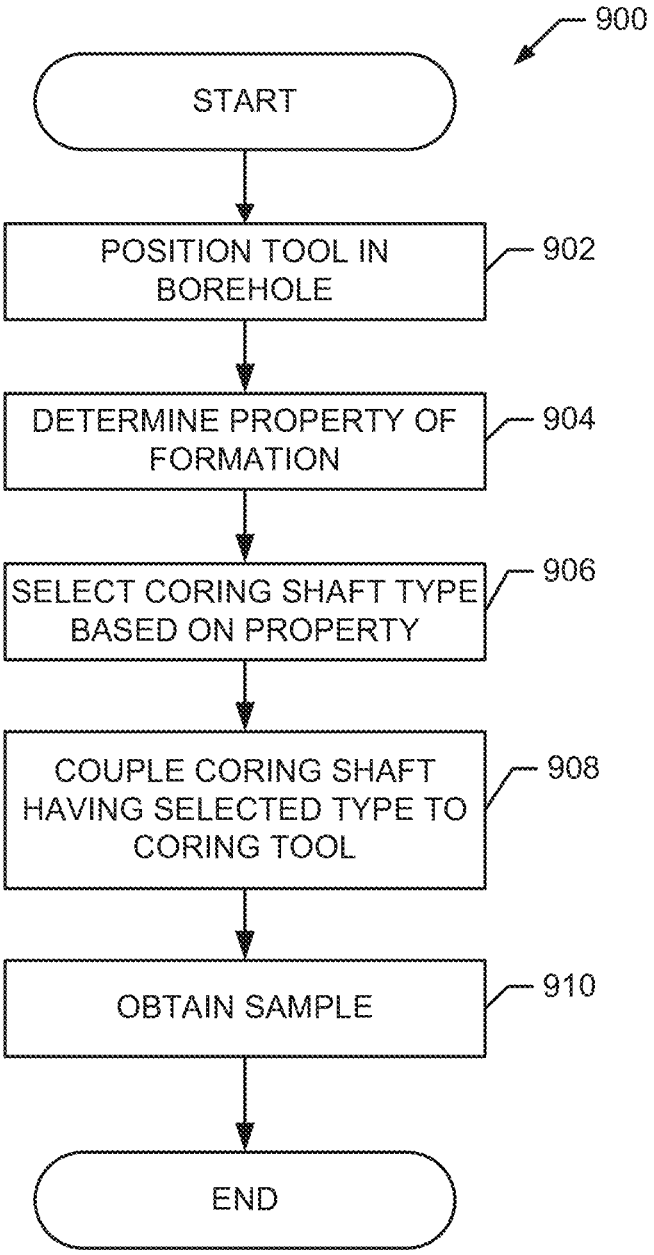
FIG. 9 is flowchart diagram of at least a portion of a method according to one or more aspects of the present disclosure.
Figure 10:
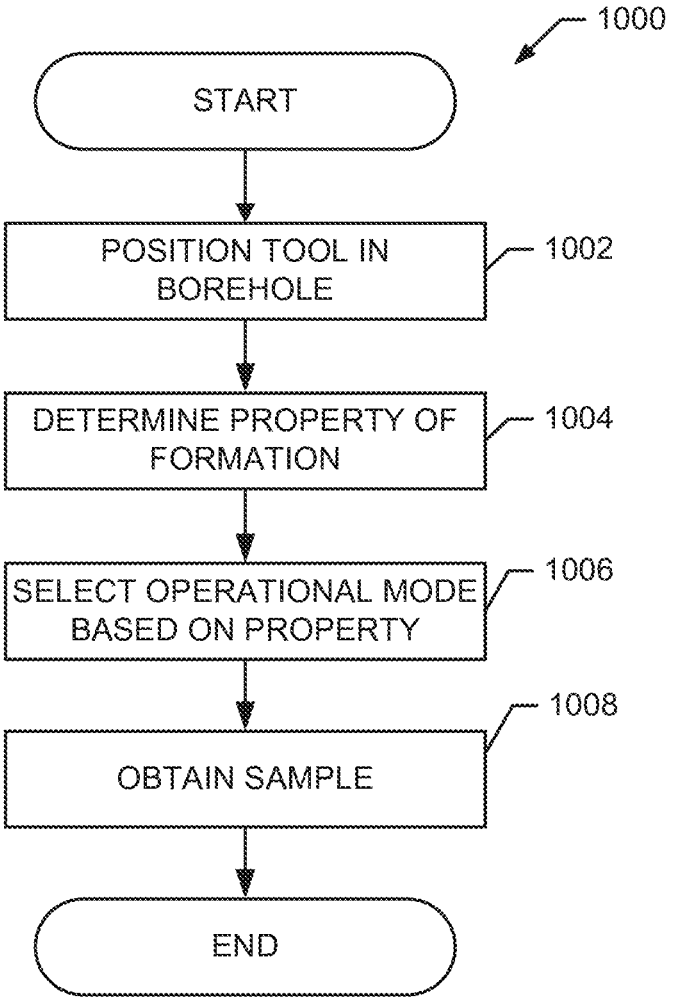
FIG. 10 is a flow chart diagram of at least a portion of another method according to one or more aspects of the present disclosure.

The example coring shafts described herein may be used in conjunction with the example method 900 of FIG. 9. Initially, a formation evaluation tool (e.g., the coring tool 10 or a downhole tool coupled to the coring tool 10) is positioned in a borehole adjacent a subterranean formation (e.g., the formation 46) (block 902). One or more properties of the formation are then determined (block 904). For example, a strength of the formation, a lithology of the formation (e.g., tar sand), and/or other properties may be determined at block 904. A coring shaft type is then selected based on the one or more properties determined at block 904 (block 906). For example, the example coring shafts of FIGS. 5-7 may be used to obtain samples from formations having an unconsolidated compressive strength that is less than 500 pounds per square inch and/or tar sand formations. The coring shaft selected at block 906 may also be selected based on whether the formation property (or properties) is defined within a value set. Such a value set may include particular target properties and/or formations that have been identified as being of particular interest for development.

Once the coring shaft type has been selected at block 906, a coring shaft having the selected type is coupled to a coring tool (block 908). The coring shaft coupled to the coring tool may be selected from a plurality of coring shafts stored in the coring tool or a portion of a downhole tool carrying the coring tool. The coring shafts may have different diameters and/or leading edges for use with different types of formations. For example, any or all of the coring shafts described here may be used. In cases where multiple coring shafts are kept at the surface, the formation evaluation tool may be withdrawn from the borehole and an appropriate one of the coring shafts (e.g., selected based on the property) may be attached to the coring tool. The coring tool may then be lowered into the borehole. Once the selected coring shaft has been coupled to the coring tool at block 908, the coring tool may then obtain a sample (for transport back to the Earth's surface) from the formation using the selected coring shaft (block 910).

The example coring shafts described herein may also be used in conjunction with the example method 1000 of FIG. 1000. Initially, a formation evaluation tool (e.g., the coring tool 10 or a downhole tool coupled to the coring tool 10) is positioned in a borehole adjacent a subterranean formation (e.g., the formation 46) (block 1002). One or more properties of the formation are then determined (block 1004). A coring operational mode is then selected based on the one or more properties determined at block 1004 (block 1006). For example, a punching or thrusting operational mode (i.e., where the coring shaft is pushed into the formation) may be selected where the one or more properties indicate a relatively soft formation. Any one of the example coring shafts of FIGS. 5-7 may, for example, be used in conjunction with a punching or thrusting operational mode. On the other hand, a drilling mode may be selected at block 1006 where the one or more properties indicate a relatively hard formation. In that case, the diamond cutter shaft/bit of FIGS. 4A and 4B may be used. Still further, the operational mode selected at block 1006 may involve determining that one formation sample is to be collected with each or a particular coring shaft or, alternatively, determining that multiple samples are to be collected with each or a particular coring shaft. Once the operational mode has been selected at block 1006, the coring tool may then obtain a sample (for transport back to the Earth's surface) from the formation using the selected operational mode (block 1008).

While in the methods 900 and 1000, the coring shafts are used to obtain samples from a subterranean formation adjacent a borehole, the example coring shafts described herein may also be used to acquire other types of samples, such as soil samples, ice samples, or samples of materials used in masonry.

Figure 11:
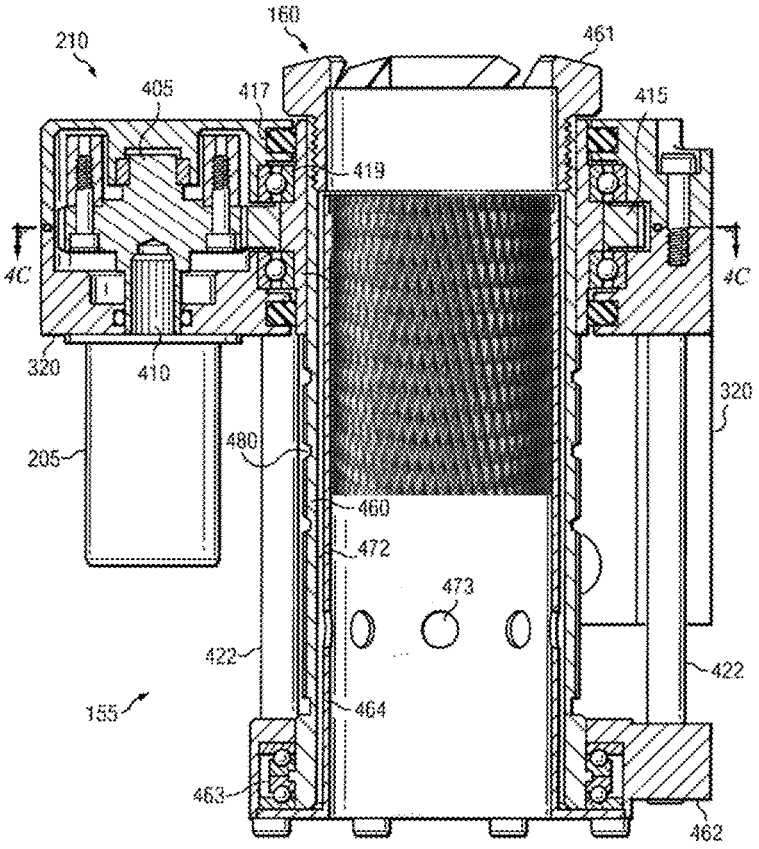
FIG. 11 is a sectional view of a coring tool according to one or more aspects of the present disclosure.

The example of FIG. 11 shows a portion of a sectional view of a coring tool. An outer hollow coring shaft 460 is to extend through a wall of a wellbore penetrating a subterranean formation. A rotationally uncoupled internal sleeve 464 is disposed inside the outer hollow coring shaft 460. U.S. Pat. No. 7,431,107, the entire disclosure of which is hereby incorporated by reference herein, describes a manner in which a sleeve may be rotationally uncoupled within a coring tool. An inner surface of the internal sleeve 464 includes any of the surface treatments or raised features described herein (e.g., FIGS. 8A-8C).

Figure 12:
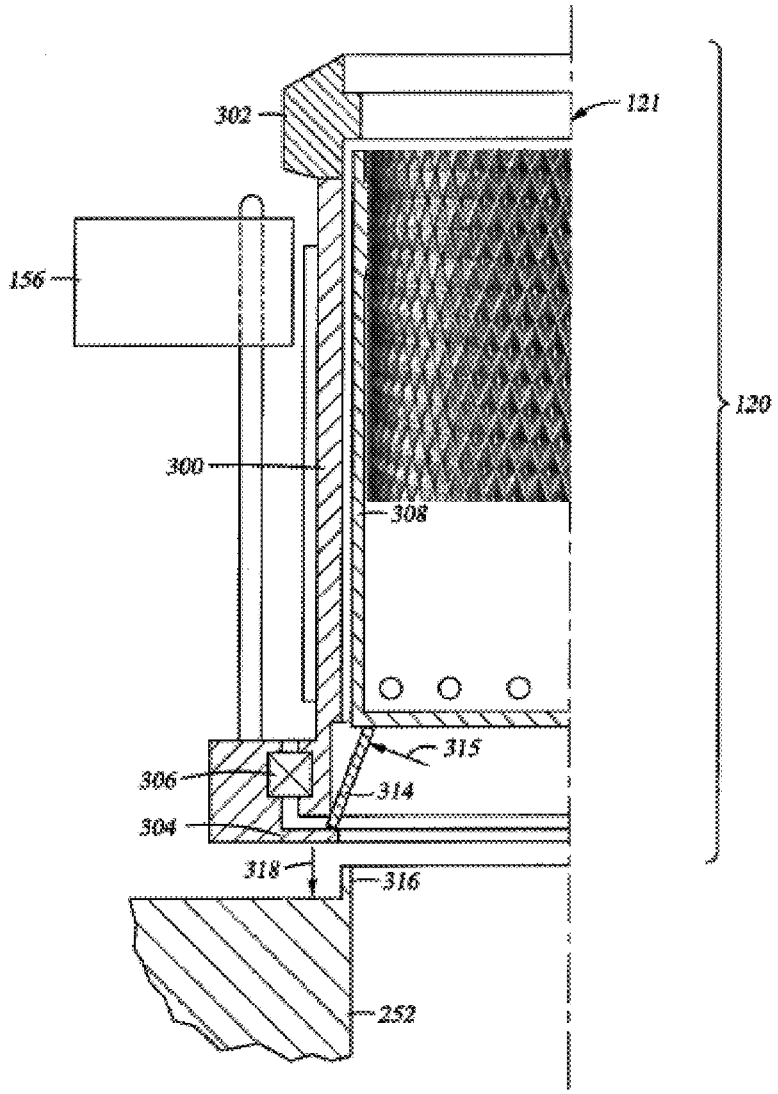
FIG. 12 is a sectional view of another coring tool according to one or more aspects of the present disclosure.

The embodiment of FIG. 12 shows a portion of a sectional view of a coring tool. The coring tool comprises a plurality of core holders to retain samples from a subterranean formation penetrated by a borehole, for example as described in U.S. Patent Application Pub. No. 2009/0114447, the entire disclosure of which is hereby incorporated by reference herein. As shown, a hollow coring shaft 300 is to receive one of the plurality of core holders, such as core holder 308. An inner surface of the core holder 308 includes any of the raised features described herein (e.g., FIGS. 8A-8C).

In view of the foregoing description and the figures, it should be clear that the present disclosure introduces coring apparatus and methods to use the same. According to certain aspects of this disclosure, an example apparatus includes a coring tool to obtain a sample. The coring tool includes a cylindrical body having a leading edge to and a cavity defined at least in part by an inner surface of the cylindrical body. The inner surface is to engage and retain a sample with a plurality of raised features, and the raised features are shaped so that at least one of the raised features or an exterior surface of a sample in the cavity deforms to increase a force required to remove the sample from the cavity.

According to other aspects of this disclosure, a method involves disposing a coring tool in a borehole adjacent a subterranean formation to be sampled, determining a property of the formation, selecting a coring shaft type based on the property, coupling a coring shaft having the selected type to the coring tool, and obtaining a sample from the formation using the coupled coring shaft.

According to other aspects of this disclosure, a method involves disposing a coring tool in a borehole adjacent a subterranean formation to be sampled, determining a property of the formation, selecting a coring tool operational mode based on the property, and obtaining a sample from the formation using the coring tool operational mode The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A coring method, comprising:

disposing a coring tool in a borehole adjacent a subterranean formation to be sampled, wherein coring tool comprises a plurality of different type coring shafts stored in the coring tool, wherein at least one of the plurality of different type coring shafts comprises a cylindrical body rotatable to obtain a sample and a cavity defined at least in part by an inner surface of the cylindrical body, the inner surface comprising a plurality of raised features to engage and retain the sample, wherein at least one of the raised features or an exterior surface of the sample in the cavity deforms to increase a force required to remove the sample from the cavity;

determining a property of the formation;

determining a coring shaft type based on the property;

coupling a coring shaft having the selected type to the coring tool, wherein the coring shaft is selected from the plurality of different type coring shafts based on the determined coring shaft type; and obtaining the sample from the formation using the coupled coring shaft.

2. The method of claim 1 wherein the plurality of different type coring shafts comprises coring shafts having different diameters from one another.

3. The method of claim 1 wherein the plurality of different type coring shafts comprises coring shafts having different leading edges from one another.

4. The method of claim 3 wherein at least one of the coring shafts comprises a wedged leading edge and another one of the coring shafts comprises a surface set diamond bit.

5. The method of claim 1 wherein determining the property comprises estimating a lithology of the formation.

6. The method of claim 5 wherein estimating the lithology of the formation comprises determining whether the formation comprises tar sand.

7. The method of claim 1 wherein determining the property comprises estimating a strength of the formation.

8. A coring method, comprising:

disposing a coring tool in a borehole adjacent a subterranean formation to be sampled, wherein the coring tool comprises a plurality of operational modes and a plurality of different type coring shafts stored in the coring tool, wherein at least one of the plurality of different type coring shafts comprises a cylindrical body rotatable to obtain a sample and a cavity defined at least in part by an inner surface of the cylindrical body, the inner surface comprising a plurality of raised features to engage and retain the sample, wherein at least one of the raised features or an exterior surface of the sample in the cavity deforms to increase a force required to remove the sample from the cavity;

determining a property of the formation;

selecting a coring tool operational mode from the plurality of operational modes, wherein the coring tool operation mode is selected based on the property; and obtaining a sample from the formation using the coring tool operational mode.

9. The method of claim 8 wherein determining the property of the formation comprises estimating a lithology of the formation.

10. The method of claim 9 wherein estimating the lithology of the formation comprises determining whether the formation comprises tar sand.

11. The method of claim 8 wherein determining the property of the formation comprises estimating a strength of the formation.

12. The method of claim 11 wherein selecting a coring tool operational mode comprises selecting a drilling mode in response to determining that the strength of the formation is relatively hard and selecting a punching mode in response to determining that the strength of the formation is relatively soft.

13. The method of claim 8 wherein selecting the coring tool operational mode comprises selecting a punching mode or a drilling mode.

14. The method of claim 8, comprising selecting from the plurality of different type coring shafts based on the property.

15. The method of claim 8, comprising selecting from the plurality of different type coring shafts based on the selected operation mode.

16. The method of claim 15, wherein selecting from the plurality of different type coring shafts comprises selecting a shaft comprising a diamond cutter bit in response to selecting a drilling mode as the selected operational mode.

17. The method of claim 15, wherein selecting from the plurality of different type coring shafts comprises selecting a shaft comprising a tapered leading edge in response to selecting a punching mode as the selected operational mode.

18. The method of claim 15, wherein selecting from the plurality of different type coring shafts comprises selecting between a first coring shaft comprising a diamond cutter bit and a second coring shaft comprising a tapered leading edge.

19. The method of claim 8, wherein selecting a coring tool operational mode comprises selecting an operational mode that collects a first core sample with a first type of coring shaft and a second core sample with a second type of coring shaft different from the first type.

20. The method of claim 19, wherein the first type of coring shaft comprises a diamond set bit and wherein the second type of coring shaft comprises a wedged leading edge.

* * * * *